US005177539A

United States Patent [19]

Tsuji

[11] Patent Number: 5,177,539

[45] Date of Patent: Jan. 5, 1993

[54] DEVELOPING DEVICE

[75] Inventor: Masaru Tsuji, Nara, Japan

[73] Assignee: Sharp Corporation, Osaki, Japan

[21] Appl. No.: 776,998

[22] Filed: Oct. 16, 1991

[30] Foreign Application Priority Data

Oct. 29, 1990 [JP] Japan ..... 2-293160

[51] Int. Cl.[5] ..... G03G 15/06

[52] U.S. Cl. ..... 355/260; 355/246

[58] Field of Search ..... 355/245, 246, 260, 200; 222/DIG. 1; 141/363, 364, 365; 220/500, 501, 503, 507, 529

[56] References Cited

U.S. PATENT DOCUMENTS 4,998,140 3/1991 Satou et al. ..... 355/245
5,012,285 4/1991 Oka et al. ..... 355/260 X
5,012,289 4/1991 Aldrich et al. ..... 355/260

FOREIGN PATENT DOCUMENTS 58-109750 7/1983 Japan .
61-73159 5/1986 Japan .
63-9237 2/1988 Japan .
63-68661 5/1988 Japan .

*Primary Examiner*—A. T. Grimley
*Assistant Examiner*—Christopher Horgan
*Attorney, Agent, or Firm*—David G. Conlin; Donald R. Castle

[57] ABSTRACT

In a developing device for use in a picture forming apparatus such as a laser printer and the like and having a developing tank and a supply tank, a sealing member for closing a path in communication with the supply tank and a toner supply outlet is provided. The sealing member is automatically switched from closed state to opened state by frictional force of a supply roller when the supply roller is rotated.

4 Claims, 2 Drawing Sheets

DEVELOPING DEVICE

BACKGROUND OF THE INVENTION

1. Field of the Invention

The present invention relates to a developing device for use in a picture forming apparatus such as an electrophotographic copier, a laser printer and the like and more particularly to a developing device of the type having a devloping tank and a supply tank and which is provided with a sealing member for closing a toner supply outlet of the supply tank before use.

2. Description of the Prior Art

An example of conventional developing device is shown in FIG. 1. The conventional developing device is of the type in which when shortage of toner takes place, the whole of the developing device is exchanged as a unit in order to make the user free from troublesome toner exchange. The developing device is for two-component development and it has a unitary structure comprised of a developing tank 1 disposed near a photoreceptor of the copier and the like and a supply tank 2 for supplying toner T to the developing tank 1, wherein a supply roller 4 is arranged at a toner supply outlet 3 of the supply tank 2 and when the concentration of toner inside the developing tank 1 is decreased, the supply roller 4 is rotated to feed the toner T to the developing tank 1.

In FIG. 1, reference numeral 5 designates a stirrer member for stirring the toner T inside the supply tank 2 so as to convey toner T toward the toner supply outlet 3. 6 a developer roller and 7 a stirrer roller.

In the aforementioned developing device, the surface of the supply roller 4 is in general foamy and therefore, when vibrations are applied to the developing device during its transportation before use, the toner T sometimes spills into the developing tank 1 through a gap formed in the supply outlet 3. As a result, the composition ratio of toner T inside the developing tank 1 exceeds an initially set reference to degrade the picture quality as compared to that initially obtained.

In connection with the above problem, a technique for preventing the spill-out of toner through the toner supply outlet of the supply tank before use has been disclosed (See Japanese Patent Laid-open No. Sho 63-9237). In this literature, as shown in FIG. 2, a sealing member 8 which can be pulled out externally during use is arranged at a toner supply outlet 3 of a supply tank 2 to close a supply tank 2.

In the prior art developing device shown in FIG. 2, however, since the sealing member 8 is pulled out externally, toner T carried on the sealing member 8 tends to be also drawn to the outside to soil the surroundings.

In addition, the user is forced to undertake the troublesome pull-out operating of the sealing member before use.

A developing device for solving the problems described so far is disclosed in U.S. Pat. No. 4,998,140. In the prior art developing device, when the main body of the developing device is attached to the copier main structure, a driving means of a take-up shaft for winding up a sealing member and a driving means of the copier main structure are connected to each other by means of a connecting means. When the power supply of the copier main structure is turned on under this condition, the take-up shaft is rotated while winding up the sealing member to remove it from the supply outlet of the supply tank.

This prior art developing device however needs the take-up shaft, driving means and connecting means which are dedicated to wind-up of the sealing member, raising a problem that the number of parts is increased to make the construction complicated.

SUMMARY OF THE INVENTION

Accordingly, the present invention intends to solve the above problems and it is an object of this invention to provide a developing device which can prevent toner from spilling out from the supply tank to the developing tank before use, can prevent the surroundings from being soiled and can make the user free from troublesome labor.

Another object of the invention is to provide a developing device having a simplified structure for pull-out of a sealing member.

To accomplish the above objects, a developing device according to the invention comprises a developing tank disposed near a photoreceptor, a supply tank for supplying toner to the developing tank, a toner supply roller arranged at a toner supply outlet of the supply tank, and a sealing member for closing a path in communication with the supply tank and the toner supply outlet so as to prevent the toner from riding on the supply roller before use, wherein the sealing member has its free end interposed between the supply roller and the rim of the supply outlet so as to be switched from closed state to opened state by frictional force of the supply roller when the supply roller is rotated.

With the above construction, when vibrations are applied to the developing device during its transportation before use, the toner inside the supply tank tends to spill out to the developing tank through the toner supply outlet.

Under the circumstances, however, the sealing member arranged near the toner supply outlet keeps closing the path in communication with the supply tank and the toner supply outlet to prevent the toner from riding on the supply roller, thus preventing the spill-out of toner inside the supply tank to the developing tank.

On the other hand, upon the supply of toner, the supply roller is rotated in the toner supply outlet in order to feed the toner inside the supply tank to the developing tank through the toner supply outlet.

As the supply roller rotates, the sealing member having its free end merely interposed between the supply roller and the rim of the supply outlet is pulled out by frictional force of the supply roller to automatically open the path in communication with the supply tank and the toner supply outlet. Consequently, the path can be switched to allow the supply of toner without requiring labor of the user.

Further, since the supply of toner can be allowed in the developing device without pulling out the sealing member externally of the supply tank and developing tank, the surroundings of the developing device can be prevented from being soiled.

Furthermore, since the sealing member is automatically pulled out as the supply roller rotates, any separate member for pull-out of the sealing member is unneeded to suppress an increase in the number of parts and consequently simplify the construction.

DESCRIPTION OF THE PREFERRED EMBODIMENTS

An embodiment of the invention will now be described with reference to the accompanying drawing.

Figure 3:
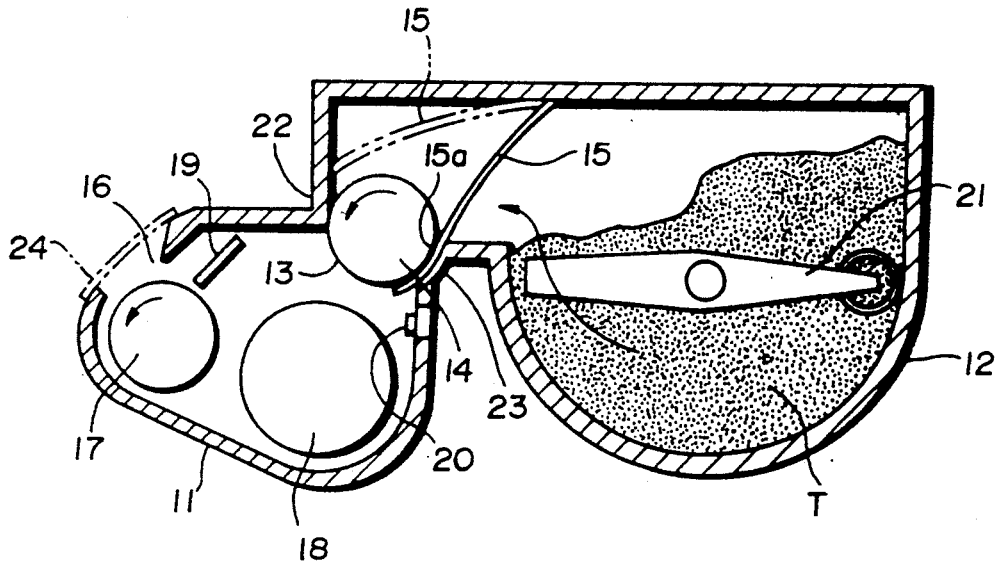
FIG. 3 is a sectional view showing an embodiment of a developing device according to the invention.

FIG. 3 shows in sectional form a developing device according to an embodiment of the invention. For example, the developing device of the present embodiment is utilized for a laser printer for two-component development and has the developing and supply tanks which are handled as a unitary structure during its transportation and its exchange as necessary. As shown in FIG. 3, the developing device comprises a developing tank 11 disposed near a photoreceptor (not shown), a supply tank 12 integral with the developing tank 11 and adapted to supply toner T to the developing tank 11, a toner supply roller 14 arranged at a toner supply outlet 13 of the supply tank 12, and a sealing member 15 provided for closing a path in communication with the supply tank 12 and the toner supply outlet 13 so as to prevent the toner T from riding on the supply roller 14 before use.

The developing tank 11 is formed with an opening 16 which opposes the photoreceptor, a developer roller 17 is arranged at the opening 16 and a stirrer roller 18 is disposed farther away from the photoreceptor than the developer roller 17.

The supply tank 12 having the toner supply outlet 13 above the stirrer roller 18 is fixedly mounted to the developing tank by means of, for example, screws to form a unitary structure.

In the figure, reference numeral 19 designates a doctor and 20 a toner concentration sensor.

Rotatably supported within the supply tank 12 is a stirrer member 21 which conveys the toner T to the supply roller 14 while stirring it.

The supply roller 14, the surface of which is foamy, is fixedly mounted to a rotary shaft and rotatable between side wall portions of the supply tank 12; and it is actuated by means of a drive unit included in the main structure of the laser printer only when the concentration of toner T inside the developing tank 11 is decreased. The supply roller 14 is so disposed as to slidably contact right and left rims 22 and 23 of the toner supply outlet 13 in order to prevent an excessive supply of toner T to the developing tank 11.

The sealing member 15 may be formed of a polyethylene terephthalate film or a paper film having a thickness set to 20 to 30 μm and it is suspended from a central portion on the upper wall of the supply tank 12. The sealing member 15 has its free end 15*a* interposed between the supply roller 14 and the right rim 23 of supply outlet 13 so as to be switched from closed state to opened state by frictional force of the supply roller 14 when the supply roller 14 is rotated. This permits the function of preventing the supply roller 14 from resting directly o the right rim 23 of the toner supply outlet 13.

The developing device is transported with its developing tank 11 charged, in advance of use, with the developing agent containing two components at a proper mixing ratio, for the convenience of the user. Therefore, to prevent the developing agent from spilling out externally, the opening 16 of the developing tank 11 is covered with a detachable sealing member 24.

When the whole of the developing device having the above construction is exchanged as a unit with a new developing device, the new device is applied with vibrations during its transportation before use and toner T inside the supply tank 12 tends to spill out to the developing tank 11 through the toner supply outlet 13.

However, the sealing member 15 arranged near the toner supply outlet 13 keeps closing the path in communication with the supply tank 12 and toner supply outlet 13 and consequently the spill-out of the toner T from the supply tank 12 to the developing tank 11 can be prevented.

Thereafter, when the developing device is ready to be used, the drive unit included in the main body of the laser printer is actuated, so that in the developing tank 11 the developer roller 17 is rotated to deposit toner T on the photoreceptor while the stirrer roller 18 being driven to stir the toner T.

Then, as the concentration of toner T inside the developing tank 11 decreases, the toner concentration sensor 20 detects a decrease in concentration, causing the stirrer member 21 inside the supply tank 12 to be rotated clockwise. As a result, toner T accumulated at the bottom of the supply tank 12 is conveyed to the supply roller 14.

Concurrently therewith, the supply roller 14 at the toner supply outlet 13 is rotated counterclockwise.

At that time, the sealing member 15 having its free end 15*a* merely interposed between the supply roller 14 and the right rim 23 of supply outlet 13 is pulled out by frictional force of the supply roller 14 as the supply roller 14 rotates, to automatically open the path in communication with the supply tank 12 and toner supply outlet 13.

Subsequently, the rotating supply roller 14 feeds the toner T from the supply tank 12 to the developing tank 11 through the toner supply outlet 13.

Figure 1:
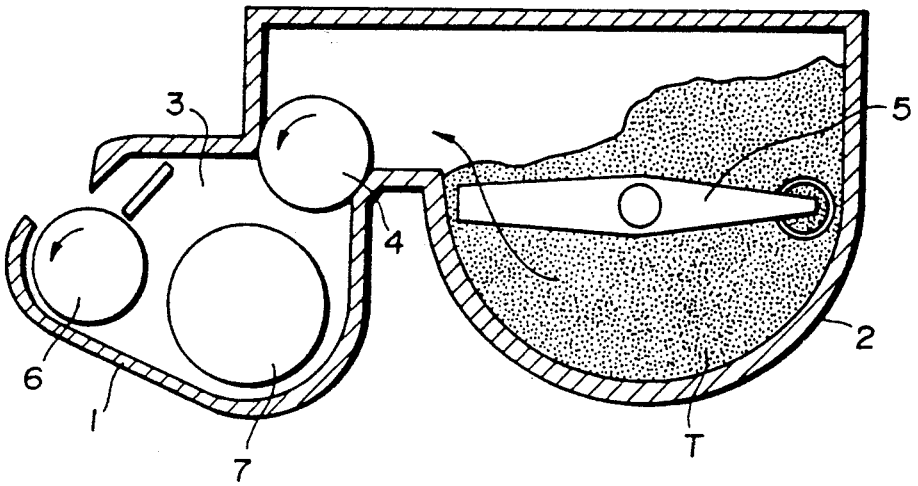
FIG. 1 (PRIOR ART)
FIG. 1 is a sectional view showing an example of conventional developing device.
Figure 2:
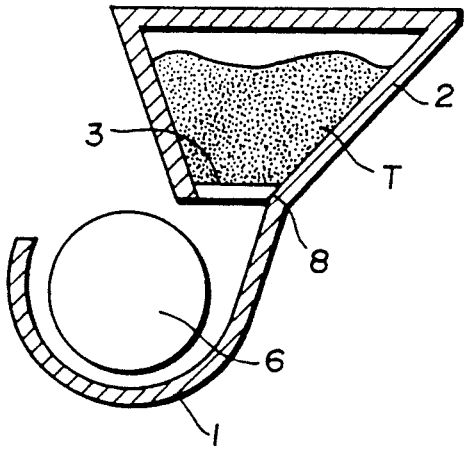
FIG. 2 (PRIOR ART)
FIG. 2 is a sectional view showing another prior art developing device.

In this manner, the toner can be prevented from being spilled out from the supply tank 12 to the developing tank 11 before use and upon the supply of toner, the sealing member 15 can be opened automatically without forcing the user to engage in troublesome labor to ensure the supply of toner T in the developing device, thereby relieving the labor of the user as compared to that required in the prior art example shown in FIG. 2.

Further, the supply of toner T in the developing device can be done without pulling out the sealing member 15 externally of the supply tank 12 and developing tank 11 to prevent the surroundings of the developing device from being soiled.

Furthermore, since the sealing member 15 is pulled out by frictional force of the rotating supply roller 14, any separate member for pull-out of the sealing member 15 is unneeded, thus suppressing an increase in the number of parts and simplifying the construction.

It should be noted that the invention is in no way limited to the foregoing embodiment but the previously-described embodiment may obviously be modified and changed in various ways within the scope the present invention.

For example, the developing and supply tanks in the foregoing embodiment have been described as being fixed to each other to form the unitary structure but they may be made to be removable from each other.

While in the foregoing embodiment the sealing member has been described as being made of the material of polyethylene terephthalate or paper, it may be made of a material other than polyethylene terephthalate, such as a thermoplastic material or a thermosetting plastic material. Of the other material, there will be available as the thermoplastic material polyethylene, polypropylene, ethylene-propylene copolymer, polyolefine resin such as ionomer, acrylic resin, polystyrane resin, As resin, ABS resin, polyamide resin, polyamide resin, polyimine resin, polyvinyl chloride resin, polyvinyliden resin, chloridevinyl acetate copolymer, vinyliden copolymer, acetal resin, diallyl phethalate resin, fluoride resin, or resin prepared by the combination of some of these resins. As the thermosetting plastic material, there will be available urea resin, phenole resin, epoxy resin, melamine resin, uretahne resin, xyleneformaldehyde resin, or resin prepared by the combination of some of these resins.

What is claimed is:

1. A developing device comprising:

a developing tank disposed near a photoreceptor;

a supply tank for supplying toner to said developing tank;

a toner supply roller arranged at a toner supply outlet of said supply tank; and a sealing member for closing a path in communication with said supply tank and said toner supply outlet so as to prevent the toner form riding on said supply roller before use, said sealing member having a pivotal end and a free end, said sealing member having its free end interposed between said supply roller and the rim of said supply outlet so as to be switched from closed state to opened state by frictional force of said supply roller when said supply roller is rotated.

2. A developing device according to claim 1 wherein said supply tank and said developing tank are fixed to each other to form a unitary structure.

3. A developing device according to claim 1 wherein the surface of said supply roller is foamy.

4. A developing device according to claim 1 wherein said sealing member has a thickness from 20 to 30 μm.

* * * * *